United States Patent [19]

Chieger et al.

[11] 3,984,961

[45] Oct. 12, 1976

[54] COMPOSITE EXTRUDED FLOOR

[75] Inventors: George Chieger, Birmingham; Tara N. Banerjea, Warren, both of Mich.

[73] Assignee: Fruehauf Corporation, Detroit, Mich.

[22] Filed: Aug. 4, 1975

[21] Appl. No.: 601,367

[52] U.S. Cl. ..... 52/593; 404/35; 52/579

[51] Int. Cl.[2] ..... E04C 1/30; E04C 3/04

[58] Field of Search ..... 52/593, 579, 600, 588, 52/593, 579; 404/34, 35, 41

[56] References Cited

UNITED STATES PATENTS

| | | | |
|---|---|---|---|
| 2,009,056 | 7/1935 | Schaffert | 52/593 |
| 3,379,221 | 4/1968 | Harry et al. | 52/615 |
| 3,385,182 | 5/1968 | Harvey | 52/579 |
| 3,450,010 | 6/1969 | Harvey | 52/579 |

FOREIGN PATENTS OR APPLICATIONS

| | | | |
|---|---|---|---|
| 376,825 | 6/1923 | Germany | 52/600 |

*Primary Examiner*—James L. Ridgill, Jr.
*Attorney, Agent, or Firm*—Harness, Dickey & Pierce

[57] ABSTRACT

The disclosure relates to a solution to the problem of distortion and deformation of the floor of a lightweight shipping container. Heretofore, relatively heavy loading of lightweight shipping containers has caused the floor thereof to deflect sufficiently to distort the side walls and end walls of the container and often permanently deform the floor. In practicing the present invention, the floor boards adjacent the side walls of the container are modified so as to increase the resistance thereof to shear loads and thus minimize deflection.

3 Claims, 5 Drawing Figures

COMPOSITE EXTRUDED FLOOR

BACKGROUND OF THE INVENTION

Reference may be had to Muir U.S. Pat. No. 3,080,021 and the references cited therein to show the state of the art of floor construction of the general type disclosed herein.

SUMMARY OF THE INVENTION

The floor of a container comprises a plurality of hollow extruded metal boards, each of which is, for example, 1 foot wide, 20 feet long, and 1¼ inches thick. Eight of the boards are required to make up the floor of a standard shipping container. The floor boards at the center of the floor have vertically disposed ribs to maximize resistance to longitudinal bending moments and crushing loads, while the boards adjacent the sides of the container have angularly disposed ribs to maximize the resistance thereof to shear loads. The boards are secured together by welding, top and bottom flanges on each board extending into complimentary notches in the top and bottom, respectively, of an adjacent board to facilitate said welding. The two outermost floor boards are provided with extended bottom flanges for attachment to the side walls of the container. Boards on opposite sides of a center board are reversed, permitting them to be made from the same set of dies.

RELATED APPLICATION

Figures 1, 2, 3, 4, 5:
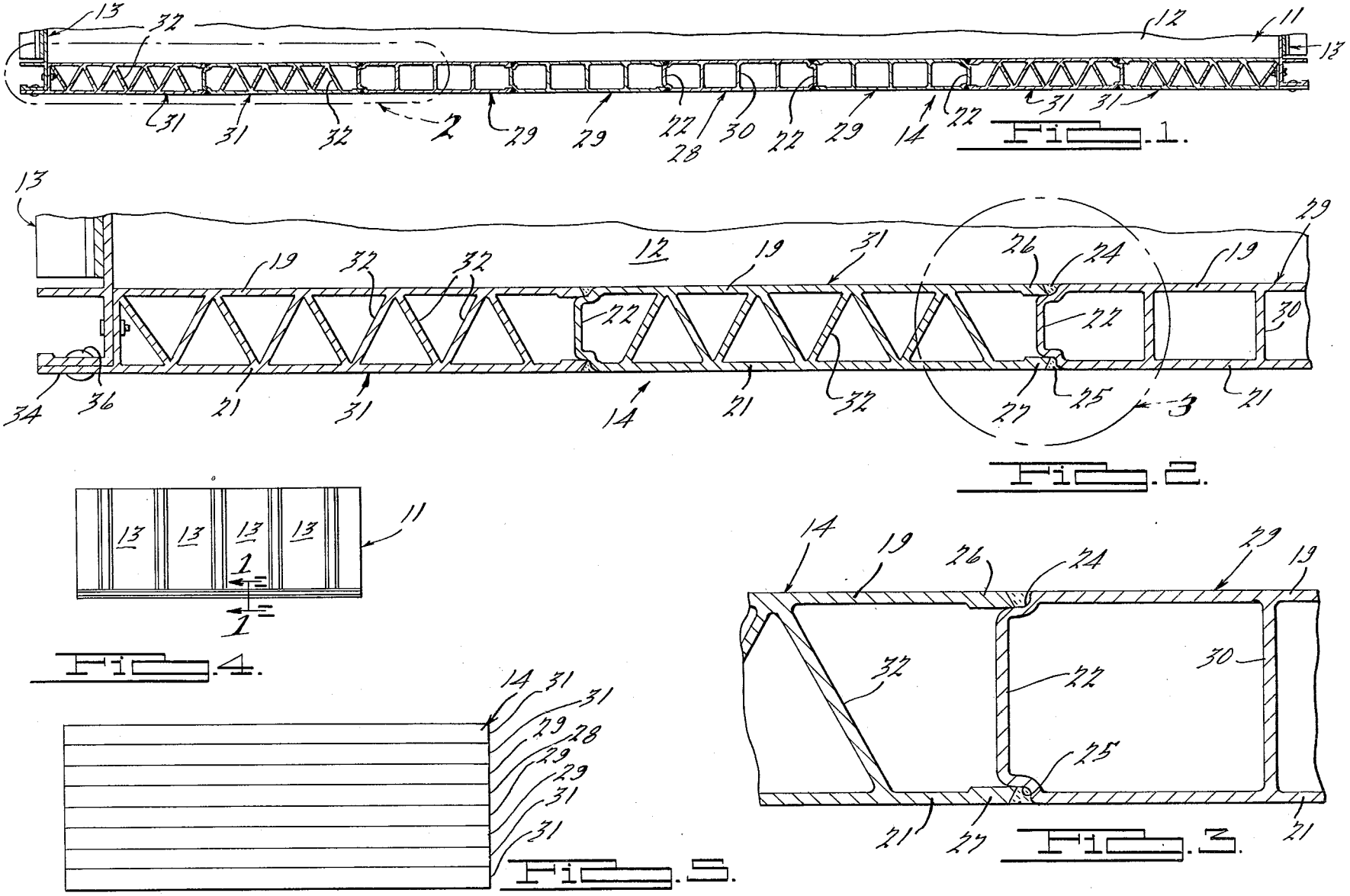
FIG. 1 is an enlarged sectional view through the floor and bottom side edges of a container embodying features of the present invention, the container being illustrated in FIG. 4 and the section being taken on the line 1—1 thereof.
FIG. 2 is an enlarged broken view of the structure illustrated in FIG. 1 as viewed within the oval 2 thereof.
FIG. 3 is an enlarged broken view of the structure illustrated in FIG. 2 taken within the circle 3 thereof.
FIG. 4 is a side view in elevation of a container having a floor which is illustrated in FIG. 1.
FIG. 5 is a plan view of the floor of the container illustrated in FIG. 4.

Reference may be had to application Ser. No. 449,638 filed Mar. 11, 1974 and assigned to the assignee of the present invention.

DESCRIPTION OF THE PREFERRED EMBODIMENT

A container 11 has an end wall 12 and side walls 13 extending upwardly from a floor 14. It will be noted from the plan view of FIG. 5 that a plurality of floor boards, eight in number, are secured together in side-by-side relation to form the floor 14. The floor 14 is, in a constructed embodiment, 20 feet in length. Each of the boards making up the floor 14 is hollow and is made of aluminum formed in an extrusion die. Each board comprises a top flange or panel 19, a bottom flange or panel 21, and a side or edge web 22. As best seen in FIG. 3, the side web 22 has notches 24 and 25 at the top and bottom thereof, respectively, for the reception of the projecting edges 26 and 27 of an adjacent board. A centrally disposed board 28 has vertical webs 22 on each side thereof to permit the boards outwardly thereof to be reversed and assembled from either side, minimizing die costs. Intermediate boards 29 have a plurality of vertical ribs or webs 30. The boards 29 are welded to the center board 28.

In accordance with the present invention, outermost boards 31 are provided with angularly related web portions 32 to maximize the resistance of the composite floor 14 to shear loads which are maximum at the side edges thereof. Thus, the angularly disposed ribs 32 form triangles which maximize the shear strength of the floor panel 14 at the point of maximum transverse shear. The vertical ribs 30 on the intermediate boards 29 and center board 28 maximize the resistance of the floor to longitudinal bending and crushing loads and minimize weight thereof. The bottom panel 21 of the outermost boards 31 has an edge extension 34 which is secured to the side wall 13 of the container 11 as by rivets 36.

From the foregoing, it should be apparent that weight of the composite floor 14 is minimized by the use of the vertical webs 30 in areas not subject to heavy shear loads whereas in areas subject to shear, the angular webs 32 maximize strength of the floor 14. Assembly and welding is facilitated by the provision of the notches 24 and 25 which accept the edge portions 26 and 27, respectively, of an adjacent panel.

We claim:

1. A composite floor structure capable of supporting a maximum load for a lightweight shipping container comprising a plurality of hollow metal boards of substantially equal width, length and thickness, means securing said boards to each other in side-by-side relation, the boards adjacent the longitudinally extending sides of said structure having angularly disposed ribs forming triangles within the boards to maximize the resistance of said floor to shear deformation, the boards forming the central portion of said floor having spaced vertically extending ribs to maximize the resistance of said floor to longitudinal bending moments and crushing loads and to minimize weight thereof.

2. A composite floor in accordance with claim 1, wherein said securing means comprises longitudinal grooves on the top and bottom of an edge portion of one of said boards with a vertical end flange therebetween, and extending aligned ends on the top and bottom panels of adjacent boards disposed in said grooves with the vertical edge flange disposed therebetween.

3. A composite floor in accordance with claim 1, wherein the pitch spacing of the angularly disposed ribs is generally equal to one-half of the pitch spacing of the vertically extending ribs.

* * * * *